United States Patent [19]

Singelyn

[11] Patent Number: 5,021,259

[45] Date of Patent: Jun. 4, 1991

[54] METHOD OF APPLYING A CONTINUOUS THERMOPLASTIC COATING WITH ONE COATING STEP

[75] Inventor: James D. Singelyn, Newington, Conn.

[73] Assignee: International Fuel Cells Corp., South Windsor, Conn.

[21] Appl. No.: 443,856

[22] Filed: Nov. 29, 1989

Related U.S. Application Data

[63] Continuation-in-part of Ser. No. 237,924, Aug. 29, 1988, abandoned.

[51] Int. Cl.[5] ..... B05D 3/02; B05D 5/08; B05D 1/10

[52] U.S. Cl. ..... 427/115; 427/375; 427/409; 427/423

[58] Field of Search ..... 427/34, 115, 375, 423, 427/422, 409

[56] References Cited

U.S. PATENT DOCUMENTS

| | | | |
|---|---|---|---|
| 2,716,075 | 8/1955 | Wiese | 427/423 X |
| 3,591,468 | 7/1971 | Nishio et al. | 204/35 R |
| 3,942,230 | 3/1976 | Nalband | 29/132 |
| 4,295,951 | 10/1981 | Bommaraju | 204/242 |
| 4,357,262 | 11/1982 | Solomon | 252/425.3 |
| 4,666,787 | 5/1987 | Bickle et al. | 428/550 |

FOREIGN PATENT DOCUMENTS

| | | | |
|---|---|---|---|
| 52-114683 | 7/1982 | Japan . | |
| 62-141165 | 6/1987 | Japan . | |
| 1087173 | 10/1987 | United Kingdom | 427/34 |

OTHER PUBLICATIONS

Dickinson, T. A., "Flame-Spraying Plastic Coatings", *Organic Finishing*, Oct. 1950, vol. 10, No. 10, pp. 11–14.

*Primary Examiner*—Evan Lawrence
*Attorney, Agent, or Firm*—William J. Sapone

[57] ABSTRACT

A continuous, pinhole-free thermoplastic polymer coating, which may be a fluoroelastomer, is applied to a porous metal surface in a single coating step by spraying the thermoplastic polymer from a thermal spray gun onto a porous metal surface which is at substantially room temperature to form a semi-fused, highly porous coating. The porous metal surface is then heated to fuse the thermoplastic polymer coating into a well-anchored, continuous film. This method permits the application of a continuous thermoplastic polymer coating with one coating step rather than with the plurality of coating steps currently needed to produce a coating with comparable properties.

10 Claims, 1 Drawing Sheet

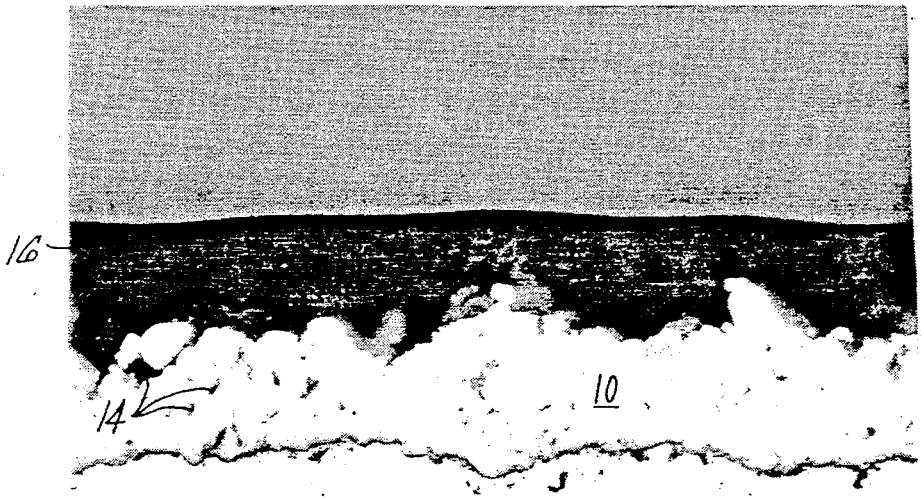
12
100X

METHOD OF APPLYING A CONTINUOUS THERMOPLASTIC COATING WITH ONE COATING STEP

This is a continuation-in-part of application Ser. No. 237,924, filed Aug. 29, 1988, now abandoned.

TECHNICAL FIELD

This invention relates to thermoplastic coatings and more specifically to fluoroelastomer coatings applied to porous metal surfaces.

BACKGROUND

Fluoroelastomer coatings have a wide variety of industrial uses. Such coatings are commonly used to provide corrosion protection for metals in corrosive services, to reduce friction between metals in sliding services, or to act as release surfaces in services in which such surfaces are desirable. Fluoroelastomers typically used as coatings include perfluoroalkoxy (PFA). In order for these materials to provide the desired properties, they should be applied to the metal substrate in such a way that they form a continuous, pinhole-free coating.

Fluoroelastomer coatings are difficult to apply to metal surfaces because they are generally inert and therefore, cannot be readily bonded chemically to metal surfaces. Moreover, fluoroelastomers have coefficients of thermal expansion several times larger than the metal substrates to which they are applied. As a result, fluoroelastomer coatings which are exposed to significant changes in temperature tend to slough off the metal substrates. Both of these problems may be overcome by mechanically bonding the fluoroelastomer to a porous metal surface, or tie coat, which can be bonded to the metal substrate. The tie coat contains numerous pores and cracks. The mechanical bond between the fluoroelastomer coating and the metal tie coat is formed when molten fluoroelastomer is allowed to flow into the pores and cracks of the tie coat and solidify.

Several techniques are available to prepare the tie coat. One method is to spray molten metal onto the surface of the substrate using a thermal or plasma spray gun. The tie coat, which cools rapidly, becomes porous as it solidifies. Another method is to electroplate a metal onto the substrate and then make it porous by reversing the polarities of the electrodes in the electroplating means. This electroplating technique is described in U.S. Pat. No. 3,591,468 to Nishio et al. The tie coat may be primed to improve fluoroelastomer adhesion. Typical primers include highly fluid fluoroelastomer compounds such as fluoroethylenepropylene (FEP) or inorganic primers such as $CaSiO_3$ or $Cr^{++}$.

The fluoroelastomer coating is normally applied to the tie coat by a series of deposition steps. Each deposition step comprises heating the tie coat to a temperature which will melt the fluoroelastomer followed by electrostatically depositing the fluoroelastomer in the form of a powder to a thickness of between approximately 0.5 mil and approximately 1 mil. A plurality of deposition steps is used to produce coatings thicker than approximately 1 mil. If this method is used to deposit coatings thicker than approximately 1 mil with a single deposition step, the coating will skin over, resulting in an aerated, porous, low density coating. Such a coating might not provide the desired protective properties. Skinning occurs when a coating which has been applied as a low density powder fuses on the surface and traps air within the rest of the coating. In addition, a coating which has been applied to a thickness greater than approximately 1 mil with a single deposition step may tend to fall from the surface of the tie coat when the coated substrate is moved.

Using this sequential deposition method to produce fluoroelastomer coatings thicker than approximately 1 mil is very time consuming and labor intensive. Labor costs can account for up to 80% of the total cost of a fluoroelastomer coating applied by this method.

Accordingly, there has been a continuous effort in this field of art to develop a quicker and less labor intensive means for producing a continuous fluoroelastomer coating of the desired thickness.

DISCLOSURE OF INVENTION

The present invention is directed towards solving the problem of applying a thermoplastic coating to a porous metal surface quickly and with a minimum amount of labor.

The invention includes a method for applying a continuous, pinhole-free thermoplastic polymer coating to a porous metal surface in one coating step. Thermoplastic polymer is sprayed from a thermal spray gun onto a porous metal surface to create a semi-fused, highly porous coating. Following the deposition of the coating, the porous metal surface onto which a coating has been sprayed, is heated in order to fuse the thermoplastic polymer coating into a well-anchored, continuous film.

The foregoing and other features and advantages of the present invention will become more apparent from the following description.

BRIEF DESCRIPTION OF DRAWING

The FIGURE shows a polished cross section of a metal substrate onto which a tie coat and a continuous fluoroelastomer coating have been applied.

BEST MODE FOR CARRYING OUT THE INVENTION

Although this invention is directed toward solving the problem of applying a fluoroelastomer coating to a porous metal surface, the invention is general and may be practiced with any suitable thermoplastic polymer. Among the suitable thermoplastic polymers, aside from fluoroelastomers, are acrylics, polyamides (nylon), polyimides, polycarbonates, polyketones (PEEK, PEK, PAK), polyetherimides, polyethylenes, polypropylenes, polyphenylene oxides, polyphenylene sulfides, polystyrenes, polyvinyldiene chloride, polyethersulfone, and polyvinylchloride.

As in the prior art, the thermoplastic coating is mechanically bonded to a metal substrate coated with a porous metal surface, or tie coat. The substrate metal and tie coat metal may be any metals appropriate for the envisioned service. For example, the substrate metal may be carbon steel or stainless steel while the tie coat may be aluminum, nickel, or chromium. The coating may comprise any fluoroelastomer or suitable thermoplastic polymer which imparts the desired protective properties. For example, the fluoroelastomer coating may be perfluoroalkoxy polymer (PFA). In an acid fuel cell environment, the coated metal surface may comprise a carbon steel substrate, an aluminum tie coat and a PFA coating.

The tie coat (10) may be prepared in any one of several ways. One way of preparing the tie coat is to spray molten metal onto the surface of the substrate metal (12) using a thermal or plasma spray gun. Another method for preparing the tie coat is to use an electroplating technique such as the to Nishio, et al., method described in U.S. Pat. No. 3,591,468, the disclosure of which is hereby incorporated by reference. Using this method, the tie coat is electroplated onto the substrate and is made porous by reversing the polarities of the electrodes, producing a metal surface containing numerous pores and cracks (14) as shown in the FIGURE.

The tie coat may be coated with a primer to enhance fluoroelastomer adhesion. Typical primers include highly fluid fluoroelastomer compounds, such as fluorethylenepropylene (FEP), or inorganic primers such as $CaSiO_3$ or $Cr^{++}$. A primer may be applied by dipping or anodizing, preferably to a thickness of between approximately 0.1 mil to approximately 0.5 mil.

Fluoroelastomer powder is then sprayed through the flame of a thermal spray gun onto the tie coat. The fluoroelastomer powder should have a nominal particle size of between 1 micron and 20 microns. The thermal spray gun should be of a type normally used to deposit metal coating, such as a METCO 6P-II THERMOSPRAY® gun available from Metco, Inc. (Westbury, N.Y.).

In order to achieve a semi-fused highly porous coating, a balance between flame temperature and residence time must be arranged with the thermal spray gun, to limit melting of the thermoplastic particles passing through the flame. Other factors such as particle size, type of thermoplastic, softening temperature, distance form the substrate, etc., must also be considered, with adjustment of the thermal spray gun believed to be within the skill of those practicing in the art. The purpose is to prevent the coalescing of the particles into a non-porous coating on contact with the substrate.

It is particularly advantageous to supply the gun with a fuel which produces the lowest flame temperature to prevent complete melting of the fluoroelastomer. Thus, it is preferred to use a low temperature burning gas such as hydrogen as the source fuel, mixed with a dilution gas such as nitrogen or air. For example, one gas combination might comprise 8% hydrogen, 50% nitrogen and 42% oxygen. Another way to reduce temperatures is to use an airless type spray gun using nitrogen as the propellant, with the nitrogen acting as a heat sink as the particles pass through the flame, absorbing a portion of the available heat. Other methods include adding sufficient dilution air or nitrogen to the fuel gas to further reduce the temperature effect on the particles. The dilution gas, by separating the particles, also assists in promoting porosity among the adhered particles. Using a relatively cool flame softens the particles passing through the flame such that they adhere to each other without melting into a homogeneous layer.

The pressure of the dilution gas should be high enough to minimize residence time but low enough to prevent the particles from impacting the surface with such force that they coalesce on contact with the substrate.

Generally, the thermal spray gun should have a flame temperature sufficient to soften the thermoplastic, yet low enough so as not to cause decomposition. For example, a temperature between 650° and 700° is ideal to form a coating when perfluoroalkoxy (PFA) powder is the material being sprayed. However, a temperature of approximately 700° F. to approximately 750° F. may also be used. Of course, the temperature should be adjusted depending on the material being sprayed, to conform with the above criteria. If the material is completely melted, a porous semi-fused coating will not be produced. It should be noted that this is contrary to the general use of a thermal spray apparatus, as most practitioners would consider the semi-fused coating to be defective. Consequently, one must disregard the teaching of high flame spray temperatures which provide complete melting and consider methods for reducing temperatures and exposure time to prevent complete melting of the particles. The tie coat should be at substantially room temperature, that is, either at room temperature or slightly heated. The hot polymer will adhere evenly across the surface of the tie coat, rapidly creating a semi-fused, highly porous coating similar to an open cell foam structure. The polymer may be applied in one coat to produce a coating with a thickness of between approximately one mil and approximately 25 mils. The coated part may be handled, moved, or stored without the semi-fused coating falling from the metal surface.

To complete the mechanical bond and to form a continuous coating, the fluoroelastomer coated metal surface is heated in a preheated oven until the coating melts down into the pores and cracks of the tie coat. The oven should be preheated to approximately 50° F. to 75° F. below the polymer's decomposition temperature. For example, if the polymer coating comprises PFA, the oven may be preheated to between approximately 750° F. and approximately 800° F. The coated metal substrate is placed into the oven in such a way that the metal is positioned toward the heat source. The metal substrate, being thermally conductive, will heat rapidly while the nonconductive polymer coating will heat much more slowly. The fluoroelastomer at the interface between the polymer coating and the tie coat melts before the rest of the coating and flows downward into the pores and cracks (14) of the porous tie coat (10). The surface of the polymer coating remains below its melting point until the rest of the coating has melted into a dense, impermeable film. The temperature difference between the surface of the coating and the rest of the coating allows the surface to remain open, preventing air from being trapped in the coating. Generally, this heating step will last no longer than several minutes. Following the heating step, the metal surface is removed from the oven and cooled. Upon cooling, the fluoroelastomer polymer solidifies to form a continuous, dense, pinhole-free coating (16) mechanically bonded to the substrate metal by means of the porous tie coat.

EXAMPLE

A continuous, pinhole-free fluoroelastomer protective coating was applied to a porous metal surface as follows. A tie coat, comprising aluminum, was deposited onto a stainless steel plate using a METCO 6P-II THERMOSPRAY® gun available from Metco, Inc. (Westbury, N.Y.) to a thickness of between 5 mils and 6 mils. No primer was applied to the tie coat. Perfluoroalkoxy (PFA) powder was thermally sprayed over the tie coat using a METCO 6P-II thermal spray gun which heats the PFA to a temperature between approximately 650° F. and approximately 700° F. to form a semi-fused coating with a thickness of between 5 mils and 6 mills. Following the deposition of the PFA coating, the coated metal surface was placed in an oven preheated to between approximately 750° F. and approximately 800° F. for approximately 10 minutes in order to fuse the PFA into a continuous, pinhole-free protective coating. The PFA coated metal was then removed from the oven and cooled.

Applying a fluoroelastomer protective coating using the method disclosed in this patent is less time consuming and requires substantially less labor than applying a similar coating with the sequential deposition method now used.

Although this invention has been shown and described with respect to detailed embodiments thereof, it will be understood by those skilled in the art that various changes in form and detail thereof may be made without departing from the spirit and scope of the claimed invention.

I claim:

1. A method of applying a continuous, pinhole free coating of thermoplastic polymer to a porous metal surface in a single coating step comprising spraying all the thermoplastic polymer, in the form of particles, required to produce the coating in a desired thickness from a thermal spray gun at a temperature at which it will only soften the particles passing therethrough such that the particles adhere but do not completely fuse onto a porous metal surface to create a semi-fused, highly porous coating, and heating the porous metal surface onto which the thermoplastic polymer has been sprayed in order to fuse the coating of thermoplastic polymer into a well-anchored, continuous film.

2. The method of claim 1 wherein the porous metal surface is coated with a primer prior to being coated with the thermoplastic polymer.

3. The method of claim 2 wherein the primer is a thermoplastic compound or an inorganic primer.

4. The method of claim 1 wherein the thermoplastic polymer is applied in a thickness of approximately 1 mil to approximately 25 mils.

5. The method of claim 4 wherein the thermoplastic polymer is applied in a thickness of approximately 5 mils to approximately 20 mils.

6. The method of claim 1 wherein the thermoplastic polymer is perfluoroalkoxy polymer.

7. The method of claim 6 wherein the perfluoroalkoxy polymer is thermally sprayed at approximately 700° F. to approximately 750° F.

8. The method of claim 6 wherein the porous metal surface onto which perfluoroalkoxy polymer has been sprayed is heated to approximately 750° F. to approximately 800° F. in order to fuse the perfluoroalkoxy polymer coating into a continuous, well-anchored film.

9. The method of claim 1 wherein the porous metal surface is the surface of a fuel cell manifold.

10. The method of claim 1 further comprising supplying the thermal spray gun with a hydrogen fuel.

* * * * *